US010203633B2

(12) United States Patent
Suzuki et al.

(10) Patent No.: US 10,203,633 B2
(45) Date of Patent: Feb. 12, 2019

(54) IMAGE FORMING APPARATUS

(71) Applicants: Michiharu Suzuki, Kanagawa (JP); Hideo Yoshizawa, Kanagawa (JP); Jun Shiori, Kanagawa (JP); Toshio Koike, Tokyo (JP); Kazuhiro Aso, Kanagawa (JP); Teppei Kikuchi, Kanagawa (JP); Keinosuke Kondoh, Kanagawa (JP)

(72) Inventors: Michiharu Suzuki, Kanagawa (JP); Hideo Yoshizawa, Kanagawa (JP); Jun Shiori, Kanagawa (JP); Toshio Koike, Tokyo (JP); Kazuhiro Aso, Kanagawa (JP); Teppei Kikuchi, Kanagawa (JP); Keinosuke Kondoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/956,790

(22) Filed: Apr. 19, 2018

(65) Prior Publication Data

US 2018/0321615 A1 Nov. 8, 2018

(30) Foreign Application Priority Data

May 8, 2017 (JP) ..... 2017-092189

(51) Int. Cl.
*G03G 15/08* (2006.01)
*G03G 15/00* (2006.01)

(52) U.S. Cl.
CPC ..... *G03G 15/0879* (2013.01); *G03G 15/0893* (2013.01); *G03G 15/6585* (2013.01)

(58) Field of Classification Search
CPC ..... G03G 15/0879; G03G 15/6585
See application file for complete search history.

(56) References Cited

U.S. PATENT DOCUMENTS 7,679,631 B2 * 3/2010 Anderson ..... G03G 15/0822 347/140
8,170,428 B2 * 5/2012 Bettiol ..... G03G 15/553 399/110

(Continued)

FOREIGN PATENT DOCUMENTS

JP 2005003951 A * 1/2005
JP 2007101903 A * 4/2007

(Continued)

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus includes an intermediate transferor, a plurality of image bearers, a plurality of developing devices, a plurality of developer containers, a plurality of conveyance paths, and a plurality of sub-hoppers. At least one set of an image bearer, a developing device, and a sub-hopper is disposed at a height different from other sets. The arrangement of the plurality of developing devices and the plurality of sub-hoppers in the rotation direction of the intermediate transferor is changed while satisfying the following. The arrangement of the plurality of developer containers is not changed and the connections between the plurality of developing devices and the plurality of sub-hoppers are not change, while the layout of the plurality of tubes as the plurality of conveyance paths is changed so that the connections between the plurality of tubes and the plurality of sub-hoppers are not changed.

10 Claims, 10 Drawing Sheets

(56) References Cited

U.S. PATENT DOCUMENTS

| | | | | |
|---|---|---|---|---|
| 8,346,138 | B2 * | 1/2013 | Sugitani | G03G 15/161 399/121 |
| 8,634,756 | B2 * | 1/2014 | Shifley | G03G 15/0121 399/401 |
| 9,176,425 | B2 * | 11/2015 | Takami | G03G 15/0887 |
| 2009/0269093 | A1 * | 10/2009 | Zehentbauer | G03G 15/0879 399/53 |
| 2014/0112687 | A1 | 4/2014 | Ohmura et al. | |
| 2014/0248061 | A1 | 9/2014 | Takami et al. | |
| 2014/0270838 | A1 | 9/2014 | Yoshizawa et al. | |
| 2015/0078788 | A1 | 3/2015 | Koike et al. | |
| 2015/0139671 | A1 | 5/2015 | Matsumoto et al. | |
| 2015/0227086 | A1 | 8/2015 | Kondoh et al. | |
| 2015/0248107 | A1 | 9/2015 | Hamada et al. | |
| 2015/0338824 | A1 | 11/2015 | Shimizu et al. | |
| 2016/0026113 | A1 | 1/2016 | Takahashi et al. | |
| 2016/0070204 | A1 | 3/2016 | Suzuki | |
| 2016/0195846 | A1 | 7/2016 | Koshizuka et al. | |
| 2016/0223946 | A1 | 8/2016 | Kikuchi et al. | |
| 2016/0306300 | A1 | 10/2016 | Hamada et al. | |
| 2016/0342134 | A1 | 11/2016 | Shiori et al. | |
| 2017/0248871 | A1 | 8/2017 | Iwatsuki et al. | |

FOREIGN PATENT DOCUMENTS

| | | |
|---|---|---|
| JP | 2012-022141 | 2/2012 |
| JP | 2014-170052 | 9/2014 |
| JP | 2015-084087 | 4/2015 |
| JP | 2016-031469 | 3/2016 |
| JP | 2016-090688 | 5/2016 |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2017-092189, filed on May 8, 2017, in the Japan Patent Office, the entire disclosure of which is hereby incorporated by reference herein.

BACKGROUND

Technical Field

This disclosure generally relates to an image forming apparatus such as a copier, a facsimile machine, a printer, or a multifunction peripheral (MFP) having at least two of copying, printing, facsimile transmission, plotting, and scanning capabilities.

Related Art

Among image forming apparatuses, such as copiers, printers, facsimile machines, or MFPs, there are image forming apparatuses that include four image forming units for colors of yellow, magenta, cyan, and black to form normal color images and additionally include an image forming unit for special color such as white or clear.

SUMMARY

According to an embodiment of this disclosure, an improved image forming apparatus includes an intermediate transferor to rotate in a predetermined rotation direction, a plurality of image bearers to bear latent images disposed in a rotation direction of the intermediate transferor, a plurality of developing devices to develop the latent images on the plurality of image bearers, a plurality of developer containers to contain developers, a plurality of conveyance paths to supply the developers contained in the plurality of developer containers to the plurality of developing devices, and a plurality of sub-hoppers to couple the plurality of conveyance paths and the plurality of developing devices. At least one set consisting of an image bearer, a developing device, and a sub-hopper is disposed at a height different from the other sets of the plurality of image bearers, the plurality of developing devices, and the plurality of sub-hoppers. The arrangement of the plurality of developer containers is unchanged. The arrangement of the plurality of developing devices and the plurality of sub-hoppers in the rotation direction are changed without changing connections between the plurality of developing devices and the plurality of sub-hoppers. The layout of the plurality of conveyance paths is changed without changing connections between the plurality of conveyance paths and the plurality of sub-hoppers.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
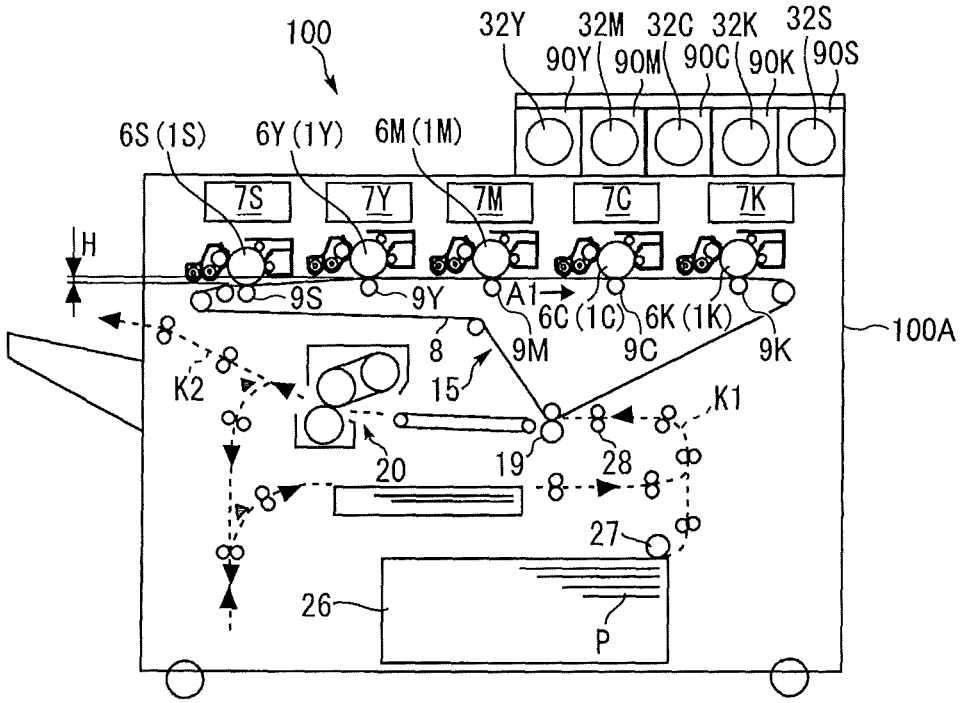
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, K, and S attached to each reference numeral indicate only that components indicated thereby are used for forming yellow, magenta, cyan, black, and special color images, respectively, and hereinafter may be omitted when color discrimination is not necessary.

Embodiments of the present disclosure are described in detail with reference to drawings. Identical reference numerals are assigned to identical components or equivalents and a description of those components is simplified or omitted.

Figure 2:
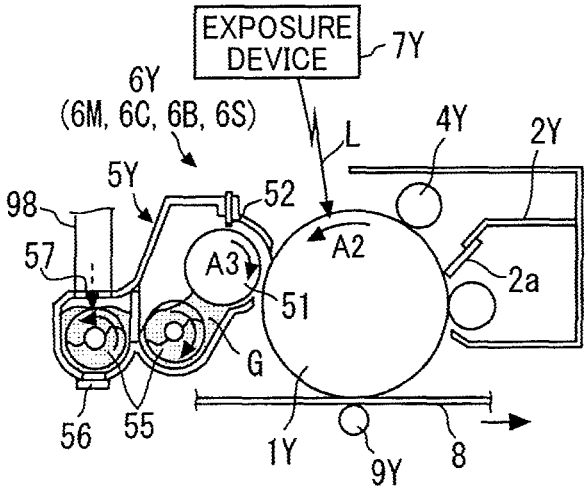
FIG. 2 is a cross-sectional view of a process cartridge of the image forming apparatus illustrated in FIG. 1.

Referring to FIGS. 1 and 2, a configuration and operation of an image forming apparatus 100 according to the present embodiment are described below.

FIG. 1 is a schematic view of an image forming apparatus 100, which in the present embodiment is a printer, for example. FIG. 2 is an enlarged view of a process cartridge 6Y of the image forming apparatus 100 illustrated in FIG. 1.

As illustrated in FIG. 1, toner supply devices 90Y, 90M, 90C, 90K, and 90S (i.e., developer supply devices) are disposed on one end side above an apparatus body 100A of the image forming apparatus 100. In the toner supply devices 90Y, 90M, 90C, 90K, and 90S, a toner container 32Y for yellow, a toner container 32M for magenta, a toner container 32C for cyan, a toner container 32K for black, and a toner container 32S for special color are respectively removably installed. The toner containers 32Y, 32M, 32C, 32K and 32S serve as developer containers and are substantially cylindrical in the present embodiment. Specifically, as illustrated in FIG. 1, toner containers 32Y, 32M, 32C (and the toner supply devices 90Y, 90M, and 90C) corresponding to three colors (yellow, magenta, and cyan) are disposed in this order from the left. A toner container 32K (and the toner supply device 90K) for black is disposed to the right of the toner containers for three colors, with a toner container 32S (and toner supply device 90S) for special color is disposed on the far right, to the right of the toner container 32K.

In particular, the toner container 32S for the special color is often replaced with a toner container 32S for another type of special color depending on usage before all of the toner contained therein is consumed. Accordingly, the toner container 32S is replaced more frequently than the other toner containers 32Y, 32M, 32C, and 32K are, and for this reason, is disposed farthest to the right to facilitate replacement.

In the present embodiment, an arrangement order of the toner containers 32Y, 32M, 32C, 32K, and 32S and an upstream portion of the toner supply devices 90Y, 90M, 90C, 90K, and 90S are invariable.

Figure 5A:
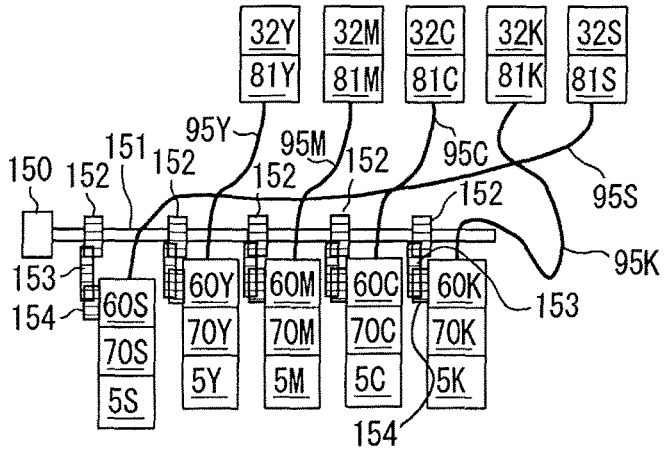
FIG. 5A is a block diagram illustrating an arrangement of components of the image forming apparatus illustrated in FIG. 1 when toner images are primarily transferred in the order of special color, color, and black from the upstream side in a rotation direction of an intermediate transfer belt in the image forming apparatus illustrated in FIG. 1.
Figure 5B:
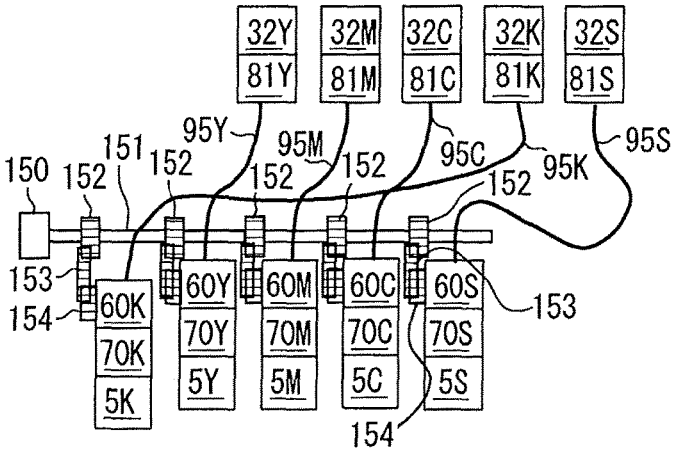
FIG. 5B is a block diagram illustrating the arrangement of components of the image forming apparatus illustrated in FIG. 1 when toner images are primarily transferred in the order of black, color, and special color from the upstream side in the rotation direction of the intermediate transfer belt in the image forming apparatus illustrated in FIG. 1.

Referring to FIGS. 1, 5A, and 5B, it can be seen that the toner supply device 90K for black supplies black toner (developer) contained in the toner container 32K (developer container) for black to a developing device 5K for black.

In addition, the three toner supply devices 90Y, 90M, and 90C for yellow, magenta, and cyan supply color toners of yellow, magenta, and cyan (developer) contained in toner containers 32Y, 32M, and 32C (developer containers) for colors to developing devices 5Y, 5M, and 5C for colors, respectively.

Furthermore, the toner supply device 90S for special color supplies special color toner (developer) contained in the toner container 32S (developer container) for special color to a developing device 5S for special color.

Any known toner can be used as the black toner; the color toner of each of yellow, magenta, and cyan; or the special color toner.

In particular, the special color toner is different from the black toner and the color toner, and known clear toner (transparent toner, colorless toner, achromatic toner, no-pigment toner, or the like), white toner, or the like can be used.

Referring to FIG. 1, five exposure devices 7Y, 7M, 7C, 7K, and 7S are disposed in an upper section of the apparatus body 100A, and process cartridges 6Y, 6M, 6C, 6K, and 6S, including the developing devices 5Y, 5M, 5C, 5K, and 5S as illustrated in FIG. 2, corresponding to yellow, magenta, cyan, black, and special color are disposed side by side therebelow, facing an intermediate transfer device 15 including an intermediate transfer belt 8.

As illustrated in FIG. 1, in the basic arrangement, the five process cartridges 6Y, 6M, 6C, 6K, and 6S, including the developing devices 5Y, 5M, 5C, 5K, and 5S, are disposed in the order of the process cartridge 6S (developing device 5S) for special color, the process cartridge 6Y (developing device 5Y) for yellow, the process cartridge 6M (developing device 5M) for magenta, the process cartridge 6C (developing device 5C) for cyan, and the process cartridge 6K (developing device 5K) for black from upstream in the direction of rotation of the intermediate transfer belt 8 (hereinafter, referred to as rotation direction). However, the arrangement order (arrangement) is appropriately variable according to usage.

Referring to FIGS. 5A and 5B, it can be seen that, in the present embodiment, the process cartridge 6K (developing device 5K) for black and the process cartridge 6S (developing device 5S) for special color can be swapped.

The special color toner is not limited to one type, and in many cases, different types of toner containers 32S for special colors are installed as appropriate depending on usage. For example, the toner container 32S for clear toner may be replaced with the toner container 32S for white toner.

In such a case, depending on the type of special color toner, preferably the process cartridge 6S (developing device 5S) for special color is moved from an extreme upstream position to an extreme downstream position in the rotation direction of the intermediate transfer belt 8. For example, the clear toner as the special color toner is often used for improving the glossiness of an image, and it is desirable that the clear toner be primarily transferred onto the intermediate transfer belt 8 first. Accordingly, as illustrated in FIGS. 1 and 5A, the process cartridge 6S (developing device 5S) for special color is disposed at the extreme upstream position in the rotation direction of the intermediate transfer belt 8. On the other hand, white toner as the special color toner is often used for forming an image on a colored recording medium P that is not white, and it is desirable that the white toner be secondarily transferred in the lowermost layer on the recording medium P. Accordingly, the process cartridge 6S (developing device 5S) for special color is disposed at the extreme downstream position in the rotation direction of the intermediate transfer belt 8 as illustrated in FIG. 5B. With the rearrangement of the installation position of the process cartridge 6S (developing device 5S) for special color, the position of the process cartridge 6K (developing device 5 K) for black is replaced with the position of the process cartridge 6S (developing device 5S). The user or service engineer manually performs the rearrangement operation according to procedures displayed on a control panel of the image forming apparatus 100.

Such an arrangement change of the process cartridge 6K for black (developing device 5K) and the process cartridge 6S (developing device 5S) for special color is described in more detail later.

Further, in the present embodiment, as illustrated in FIGS. 1 and 5A, the process cartridge 6S (and a sub-hopper 70S and a conveyance pump 60S) positioned at the extreme upstream position among five process cartridges 6Y, 6M, 6C, 6K, and 6S (and sub-hoppers 70Y, 70M, 70C, 70K, and 70S; and conveyance pumps 60Y, 60M, 60C, 60K, and 60S) is disposed lower than the four process cartridges 6Y, 6M, 6C, and 6K (and the sub-hoppers 70Y, 70M, 70C, and 70K; and the conveyance pumps 60Y, 60M, 60C, and 60K) by a predetermined value H in the vertical direction The predetermined value H is determined by layout design of the apparatus body 100A, for example, positions of the process cartridges 6, the intermediate transfer belt 8, or the like.

Specifically, as illustrated in FIG. 1, four photoconductor drums 1Y, 1M, 1C, and 1K of the four process cartridges 6Y, 6M, 6C, and 6K, which are not at the extreme upstream position, contact the intermediate transfer belt 8 at the positions (that is, primary transfer nips) on a substantially horizontal straight line. On the other hand, the contact position (primary transfer nip) between the photoconductor drum 1S of the extreme upstream process cartridge 6S and the intermediate transfer belt 8 is not on the horizontal straight line, and lower than those of the other four photoconductor drums 1Y, 1M, 1C, and 1K. The process cartridges 6Y, 6M, 6C, 6K, and 6S (and the sub-hoppers 70Y, 70M, 70C, 70K, and 70S; and the conveyance pumps 60Y, 60M, 60C, 60K, and 60S) are arranged in accordance with the positional relation of the photoconductor drums 1Y, 1M, 1C, 1K, and 1S.

Referring to FIG. 2, the process cartridge 6Y for yellow is a removable unit removably mounted in the apparatus body 100A and includes the photoconductor drum 1Y serving as an image bearer and further includes a charger 4Y, the developing device 5Y, and a cleaner 2Y disposed around the photoconductor drum 1Y. Image forming processes, namely, charging, exposure, development, transfer, and cleaning processes are performed on the photoconductor drum 1Y, and thus a yellow toner image is formed on the photoconductor drum 1Y.

Note that other process cartridges 6M, 6C, 6K, and 6S have a similar configuration to that of the yellow process cartridge 6Y except the color of the toner used therein and form magenta, cyan, black, and special color toner images, respectively. Thus, only the process cartridge 6Y is described below and descriptions of other process cartridges 6M, 6C, 6K, and 6S are omitted.

Referring to FIG. 2, the photoconductor drum 1Y as the image bearer is rotated counterclockwise indicated by arrow A2 in FIG. 2 by a driving motor. The charger 4Y uniformly charges a surface of the photoconductor drum 1Y at a position opposite the charger 4Y (a charging process).

When the photoconductor drum 1Y reaches a position to receive a laser beam L emitted from the exposure device 7Y (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the electrostatic latent image is developed with toner into a yellow toner image (a development process).

When the surface of the photoconductor drum 1Y carrying the toner image reaches a position facing a primary transfer roller 9Y via the intermediate transfer belt 8 as an intermediate transferor, the toner image is transferred therefrom onto the intermediate transfer belt 8 (a primary transfer process). After the primary transfer process, a certain amount of residual, untransferred toner remains on the photoconductor drum 1Y.

When the surface of the photoconductor drum 1Y reaches a position facing the cleaner 2Y, a cleaning blade 2*a* collects the untransferred toner from the photoconductor drum 1Y into the cleaner 2Y (a cleaning process).

Subsequently, the surface of the photoconductor drum 1Y reaches a position facing the discharger, and the discharger eliminates residual potential from the photoconductor drum 1Y.

Thus, a sequence of image forming processes performed on the photoconductor drum 1Y is completed.

The above-described image forming processes are performed in the process cartridges 6M, 6C, 6K, and 6S similarly to the yellow process cartridge 6Y. That is, the exposure devices 7M, 7C, 7K, and 7S disposed above the process cartridges 6M, 6C, 6K, and 6S emit the laser beams L according to image data onto respective photoconductor drums 1M, 1C, 1K, and 1S of the process cartridges 6M, 6C, 6K, and 6S. Specifically, the exposure device 7 includes light sources to emit the laser beams L, multiple optical elements, and a polygon mirror that is rotated by a motor. The laser beams L are directed to the respective photoconductor drums 1Y, 1M, 1C, 1K, and 1S via the multiple optical elements while being deflected by the polygon mirror.

Then, the toner images formed on the respective photoconductor drums 1Y, 1M, 1C, 1K, and 1S through the development process are primarily transferred therefrom and deposited one on another onto the intermediate transfer belt 8. Thus, a desired multicolor toner image is formed on the intermediate transfer belt 8.

In FIG. 1, the intermediate transfer device 15 includes the intermediate transfer belt 8 as the intermediate transferor, the five primary transfer rollers 9Y, 9M, 9C, 9K, and 9S, a driving roller, a secondary transfer backup roller, multiple tension rollers, a cleaning backup roller, and a belt cleaner. The intermediate transfer belt 8 is supported by and entrained around multiple rollers to rotate in the rotation direction (clockwise) indicated by arrow A1 illustrated in FIG. 1 as one (the driving roller) of the multiple rollers rotates.

Specifically, the five primary transfer rollers 9Y, 9M, 9C, 9K, and 9S are pressed against the corresponding photoconductor drums 1Y, 1M, 1C, 1K, and 1S with the intermediate transfer belt 8 therebetween. The five areas of contact between the primary transfer rollers 9Y, 9M, 9C, 9K, and 9S and the corresponding photoconductor drums 1Y, 1M, 1C, 1K, and 1S are hereinafter referred to as the primary transfer nips. A transfer voltage (a primary transfer bias) opposite in polarity to the toner is applied to each of the primary transfer rollers 9Y, 9M, 9C, 9K, and 9S.

The intermediate transfer belt 8 rotates in the direction indicated by arrow A1 in FIG. 1 and sequentially passes through the primary transfer nips. Then, the single-color toner images are transferred from the respective photoconductor drums 1Y, 1M, 1C, 1K, and 1S primarily and deposited one on another onto the intermediate transfer belt 8.

Then, the intermediate transfer belt 8 carrying the multicolor toner image reaches a position facing the secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a recording medium P such as a sheet transported to the secondary transfer nip (a secondary transfer process). A certain amount of toner untransferred to the recording medium P remains on the intermediate transfer belt 8 after the secondary transfer process.

Subsequently, the surface of the intermediate transfer belt 8 reaches a position facing the belt cleaner. There, the untransferred toner remaining on the intermediate transfer belt 8 is collected by the belt cleaner.

Thus, a sequence of image transfer processes performed on the intermediate transfer belt 8 is completed.

Referring back to FIG. 1, it is to be noted that the recording medium P is transported from a sheet feeder 26 (specifically, a sheet tray) disposed in a lower portion of the apparatus body 100A to the secondary transfer nip through a sheet feeding path K1, along which a sheet feeding roller 27 and a registration roller pair 28 are disposed.

Specifically, the sheet feeder 26 contains a stack of multiple sheets of recording media P. The sheet feeding roller 27 rotates counterclockwise in FIG. 1 to feed the recording medium P on the top of the stack in the sheet feeder 26 toward a nip of the registration roller pair 28.

The registration roller pair 28 (timing roller pair) stops rotating temporarily, stopping the recording medium P with a leading edge of the recording medium P nipped in the registration roller pair 28. The registration roller pair 28 rotates to transport the recording medium P to the secondary transfer nip, timed to coincide with the arrival of the multicolor toner image on the intermediate transfer belt 8. Thus, the multicolor toner image is transferred onto the recording medium P.

The recording medium P carrying the multicolor toner image is transported to a fixing device 20. In the fixing device 20, a fixing belt and a pressing roller apply heat and pressure to the recording medium P to fix the multicolor toner image on the recording medium P (a fixing process).

Subsequently, the recording medium P is transported through a discharge path K2 and discharged by a pair of discharge rollers outside the image forming apparatus 100. The recording media P are sequentially stacked as output images on a stack tray.

Thus, a series of image forming processes performed by the image forming apparatus 100 is completed.

Next, a configuration and operation of the developing device 5Y of the process cartridge 6Y is described in further detail below with reference to FIG. 2.

A casing of the developing device 5Y to contain the developer G is divided, at least partially, into two developer containing compartments. The developing device 5Y includes a developing roller 51 disposed facing the photoconductor drum 1Y, a doctor blade 52 disposed facing the developing roller 51, two conveying screws 55 respectively disposed in the developer containing compartments, a density detector 56 to detect concentration (percentage) of toner in developer G or toner density, and an opening 57 for supplying toner (developer) to the developer containing compartment. The developing roller 51Y includes stationary magnets, a sleeve that rotates around the magnets, and the like. A developer container contain two-component developer G including carrier (carrier particles) and toner (toner particles).

The developing device 5Y operates as follows.

The sleeve of the developing roller 51 rotates in a direction indicated by arrow A3 illustrated in FIG. 2. The developer G is carried on the developing roller 51 by a magnetic field generated by the magnets. As the sleeve rotates, the developer G moves along a circumference of the developing roller 51.

The percentage (concentration) of toner in the developer G (ratio of toner to carrier) in the developing device 5Y is adjusted within a predetermined range. Specifically, according to the consumption of toner in the developing device 5Y, the toner supply device 90Y (illustrated in FIG. 3) supplies toner (i.e., powder) from the toner container 32Y (developer container) to the developing device 5Y (the developer containing compartment in particular). A configuration and operation of the toner container 32Y and the toner supply device 90Y are described in further detail later.

While being stirred with the developer G and circulated by the two conveying screws 55 in the developing device 5Y (the developer containing compartments), the supplied toner is circulated between the two developer containing compartments in a longitudinal direction of the developing device 5Y, which is perpendicular to the surface of the paper on which FIG. 2 is drawn. The toner in two-component developer G is charged by friction with carrier and electrostatically attracted to the carrier. Then, the toner is carried on the developing roller 51 together with the carrier by a magnetic force generated on the developing roller 51.

The developer G carried on the developing roller 51 is transported in the clockwise direction indicated by arrow A3 in FIG. 2 to the doctor blade 52. The amount of developer G on the developing roller 51 is adjusted by the doctor blade 52, after which the developer G is carried to a developing range facing the photoconductor drum 1Y. Then, the toner in the developer G adsorbs to the electrostatic latent image formed on the photoconductor drum 1Y due to the effect of an electric field generated in the developing range. As the sleeve rotates, the developer G remaining on the developing roller 51 reaches an upper part of the developer container, drops from the developing roller 51, and returns to the developer containing compartment.

Figure 3:
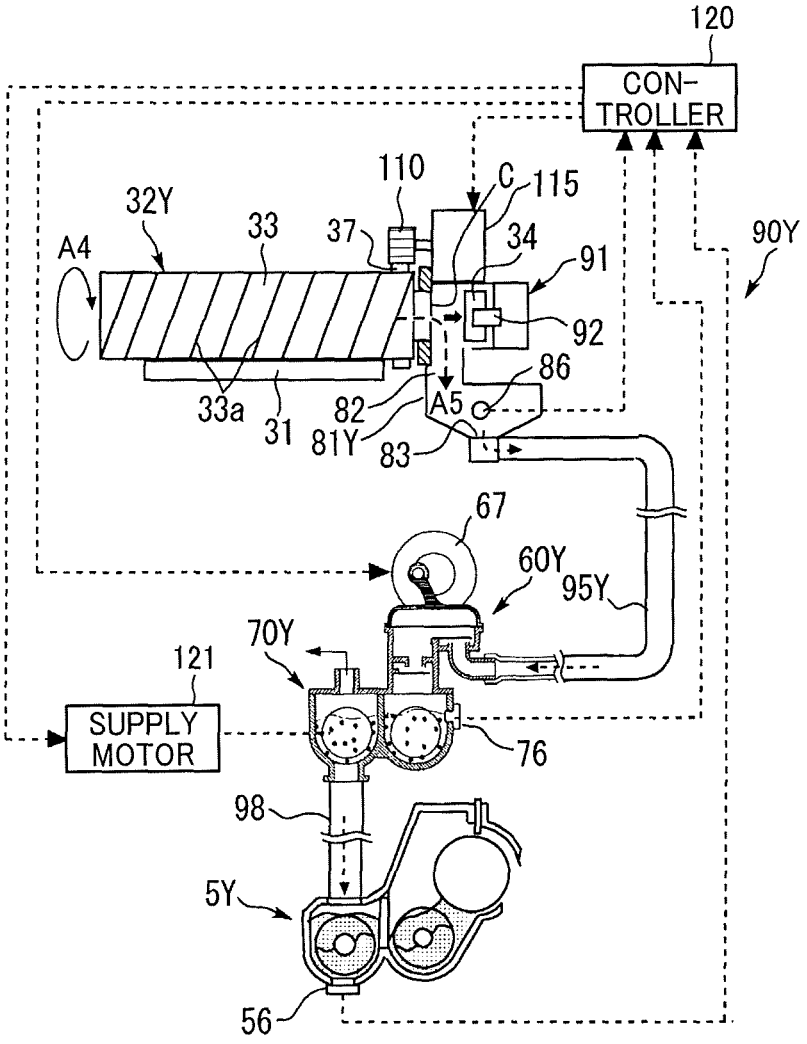
FIG. 3 is a schematic view of a developer supply device of the image forming apparatus illustrated in FIG. 1.

Next, a configuration and operation of the toner supply device 90Y for yellow illustrated in FIG. 3 is described.

In the present embodiment, the four other toner supply devices (the toner supply device 90M for magenta, the toner supply device 90C for cyan, the toner supply device 90K for black, and the toner supply device 90S for special color) have substantially the same configuration as that of the toner supply device 90Y for yellow, except that the color (type) of the toner to be used is different. Therefore, descriptions of the toner supply devices 90M, 90C, 90K, and 90S are appropriately omitted, and only the toner supply device 90Y for yellow is described.

The toner supply device 90Y rotates the toner container 32Y as the developer container installed in an installation portion 31 in a predetermined direction (direction indicated by arrow A4 in FIG. 3), discharges the toner contained in the toner container 32Y to the outside of the toner container, and guides the toner to the developing device 5Y, thereby forming a toner supply route (toner transport route).

In FIG. 3, the arrangement direction of the toner container 32Y, the toner supply device 90Y, and the developing device 5Y are changed for ease of understanding. In the present embodiment, the long axis of the toner container 32Y and a part of the toner supply device 90Y are perpendicular to the surface of the paper on which FIG. 3 is drawn (see FIG. 1). In addition, the orientation and arrangement of a tube 95Y (conveyance path) are also illustrated in a simplified manner.

The yellow toner contained in the toner container 32Y installed in the installation portion 31 are supplied to the developing device 5Y by the toner supply devices 90Y corresponding to an amount of toner consumed in the developing device 5Y.

Specifically, when the toner container 32Y is set in the installation portion 31 of the apparatus body 100A, a bottle gear 37 of the toner container 32Y meshes with the driving gear 110 of the apparatus body 100A and the cap chuck 92 of the cap receiver 91 removes a cap 34, which is for closing a toner outlet C, from the toner container 32Y. Accordingly, the toner outlet C of the toner container 32Y is opened, and the yellow toner is discharged from the toner container 32Y through the toner outlet C.

In the toner supply device 90Y, the reservoir 81Y is disposed below the toner outlet C via a falling path 82. A suction port 83 is disposed in the bottom portion of the reservoir 81Y, and the suction port 83 is coupled to one end of the tube 95Y (conveyance path) via a nozzle. The tube 95Y is formed of a flexible material with low affinity for toner, and the other end of the tube 95Y is coupled to a conveyance pump 60Y (diaphragm pump). The conveyance pump 60Y is coupled to the developing device 5Y via a sub-hopper 70Y and a conveyance pipe 98.

With such a configuration of the toner supply device 90Y, as the driving gear 110 is driven by the driving motor 115, a container body 33 of the toner container 32Y is rotated in a predetermined direction, thereby discharging toner from the toner outlet C of the toner container 32Y. Accordingly, toner discharged from the toner outlet C of the toner container 32Y falls through the falling path 82, and is stored in the reservoir 81Y. As the conveyance pump 60Y is operated, the toner stored in the reservoir 81 is sucked from the suction port 83 and is transported to the conveyance pump 60Y, and to the sub-hopper 70Y via the tube 95Y. Then, the toner conveyed to the sub-hopper 70Y is supplied into the developing device 5Y via the conveyance pipe 98 extending in the vertical direction. That is, the toner in the toner container 32Y is conveyed in the direction indicated by broken line arrows A5 in FIG. 3. In the present embodiment, unlike the tube 95Y, the conveyance pipe 98 that couples between the sub-hopper 70Y and the developing device 5Y is formed of a hard resin material or a metal material which is hardly deformed.

Next, the conveyance pump 60Y and the sub-hopper 70Y of the toner supply device 90Y are described in detail with reference to FIG. 4.

Figure 12:
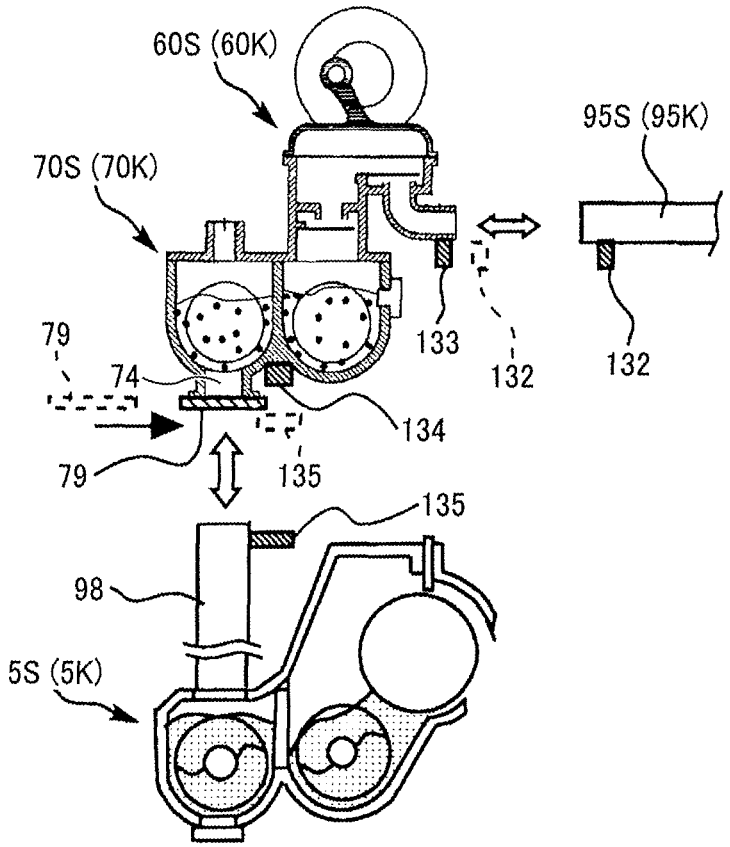
FIG. 12 is a schematic view illustrating an installation of a developing device, the conveyance pump, and the sub-hopper in the developer supply device, respectively.

In the present embodiment, the conveyance pump 60Y forms a unit including the sub-hopper 70Y (see also FIG. 12).

Figure 4:
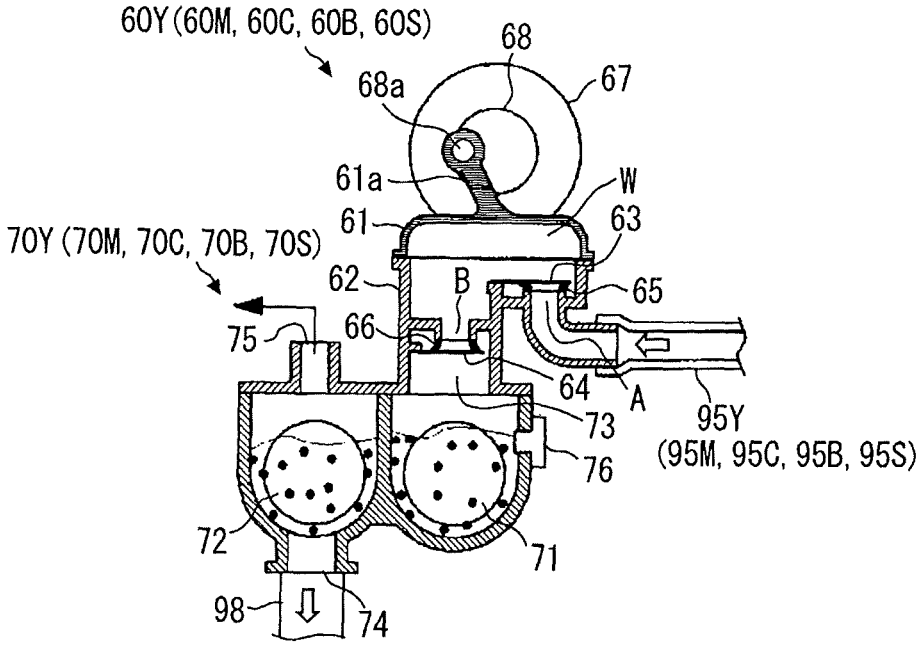
FIG. 4 is a cross-sectional view of a conveyance pump and a sub-hopper of the developer supply device in FIG. 3.

Referring to FIG. 4, the conveyance pump 60Y in the present embodiment is a diaphragm pump (positive displacement pump) and includes a diaphragm 61 (rubber member), a case 62, a motor 67, a rotary plate 68, an inlet check valve 63 and an outlet check valve 64, seals 65 and 66 (elastic members), and the like. The conveyance pump 60Y with such a configuration is relatively small and low in cost.

The case 62 and the diaphragm 61 together form the body of the conveyance pump 60Y.

The case 62 is made of a resin material or a metal material having good rigidity and functions as a main part (housing) of the body of the conveyance pump 60Y. An inlet A for bringing the developer together with air into the interior and an outlet B for discharging the developer together with air from the interior are disposed in the case 62 (pump body).

The diaphragm 61 is formed of a rubber material having elasticity and a low affinity for toner. The interior of the bowl-like portion functions as a variable volume portion W, and an arm 61*a* stands on the periphery thereof. An eccentric shaft 68*a* of a rotary plate 68 engages a hole of the arm 61*a*. The diaphragm 61 is joined with the case 62 without a gap, and the variable volume portion W of the diaphragm 61 and the inside of the case 62 are formed as one closed space inside the body of the conveyance pump 60Y (i.e., pump body). The diaphragm 61 expands and contracts by the rotary plate 68 (the eccentric shaft 68*a*) to be described later, thereby increasing and decreasing the internal volume. Therefore, the body of the conveyance pump 60Y (i.e., diaphragm 61 and case 62) alternately generate the positive pressure and the negative pressure.

The rotary plate 68 is disposed on the motor shaft of a motor 67, and an eccentric shaft 68*a* is provided on the surface thereof so as to stand upright at a position offset from the motor shaft (rotational center). The eccentric shaft 68*a* of the rotary plate 68 is inserted (fitted) into the hole formed in a tip of the arm 61*a* of the diaphragm 61.

With this configuration, as the motor 67 is driven by a controller 120, the rotary plate 68 (the eccentric shaft 68*a*) rotates. Accordingly, the diaphragm 61 expands and contracts so as to increase and decrease the volume of the variable volume portion W periodically. With such expansion and contraction of the diaphragm 61, the positive pressure and the negative pressure are alternately generated inside the pump body composed of the diaphragm 61 and the case 62.

The inlet check valve 63 is disposed at the inlet A of the pump body (case 62). The inlet check valve 63 opens the inlet A when the negative pressure is generated inside the pump body and closes the inlet A when the positive pressure is generated inside the pump body. The inlet check valve 63 is provided to face the inlet A from the inside of the pump body. The reservoir 81Y is coupled to the inlet A of the conveyance pump 60Y via the tube 95Y.

On the other hand, an outlet check valve 64 is disposed at the outlet B of the pump body (case 62). The outlet check valve 64 closes the inlet B when the negative pressure is generated inside the pump body and opens the outlet B when the positive pressure is generated inside the pump body. The outlet check valve 64 is provided to face the outlet B from the outside of the pump body. The sub-hopper 70Y is coupled to the outlet B of the conveyance pump 60Y.

With such a configuration and operation, as described above with reference to FIG. 3, as the conveyance pump 60Y operates, the toner stored in the reservoir 81Y, serving as a supply source, is sucked from the suction port 83 and conveyed into the sub-hopper 70Y through the tube 95Y. Specifically, when a hopper sensor 76 of the sub-hopper 70Y detects a shortage of toner in the sub-hopper 70Y, the conveyance pump 60Y (motor 67) is driven to supply toner from the reservoir 81Y to the sub-hopper 70Y.

When the hopper sensor 76 detects that the amount of toner in the sub-hopper 70Y has not reached a predetermined amount and an insufficient state is detected, similarly to the known one, the conveyance pump 60Y (motor 67) is intermittently driven in short cycles. As a result, the amount of toner conveyed by a first conveyance screw 71 and a second conveyance screw 72 in the sub-hopper 70Y can catch up with the amount of toner supplied from the conveyance pump 60Y, thereby preventing toner from stagnating in a part of the sub-hopper 70Y.

Referring to FIG. 4, the first conveyance screw 71, the second conveyance screw 72, the hopper sensor 76, a supply motor 121 (see FIG. 3), and the like are provided in the sub-hopper 70Y (a supply destination). A supply port 73 communicating with the outlet B of the conveyance pump 60Y is disposed above an upstream side of a first conveying path of the sub-hopper 70Y in the direction of conveyance of toner. The first conveyance screw 71 is disposed in the first conveying path. A discharge port 74 is disposed under a downstream side of a second conveying path of the sub-hopper 70Y in the direction of conveyance of toner, and communicates with the developing device 5Y via the conveyance pipe 98. The second conveyance screw 72 is disposed in the second conveying path. Further, an exhaust port 75 for discharging air fed together with the toner from the conveyance pump 60Y is disposed above the second conveying path of the sub-hopper 70Y.

As described above, the hopper sensor 76 detects the insufficient state in which the toner (developer) amount contained in the sub-hopper 70 is below the predetermined amount.

In the sub-hopper 70Y, a downstream side of the first conveying path and an upstream side of the second conveying path communicate with each other (i.e. a communicating portion) on one end side in the longitudinal direction of the sub-hopper 70Y perpendicular to the paper on which FIGS. 3 and 4 are drawn. The first conveying path and the second conveying path are separated by the wall except for the communicating portion.

The toner supplied into the sub-hopper 70Y is conveyed through the first conveying path and the second conveying path in the sub-hopper 70Y by the first conveyance screw 71 and the second conveyance screw 72 rotated by the supply motor 121 and is supplied to the developing device 5Y via the conveyance pipe 98. Specifically, when the density detector 56 of the developing device 5Y detects a shortage of the toner concentration in the developer containing compartment (a circulation path in which the conveying screw 55 circulates the toner), the controller 120 rotates the first conveyance screw 71 and the second conveyance screw 72 of the sub-hopper 70Y, thereby supplying the toner from the sub-hopper 70Y to the developing device 5Y.

As described above, in the present embodiment, the conveyance path extending from the reservoir 81Y to the conveyance pump 60Y is formed with the flexible tube 95Y. Therefore, even when various components are installed in the space between the reservoir 81Y and the conveyance pump 60Y, the tube 95Y can be installed avoiding those components to secure the conveyance path. Therefore, the installation portion 31 of the toner container 32Y can be freely laid out at a position away from the developing device 5Y.

Next, referring to FIG. 3, configurations of the toner container 32Y and the toner supply device 90Y are described below.

As described above, the toner container 32Y includes the container body 33 and the cap 34 detachably attachable to toner outlet C of the container body 33.

A bottle gear 37 that rotates together with the container body 33 and the toner outlet C are disposed on a head portion of the container body 33. The bottle gear 37 meshes with the driving gear 110 of the apparatus body 100A, and the driving gear 110 rotates the container body with the bottle gear 37 in a predetermined direction. The toner outlet C is for discharging toner (powder) from the container body 33 to the falling path 82.

The container body 33 includes a spiral protrusion 33*a* protruding inward from an outer circumferential face to an inner circumferential face thereof. In other words, a spiral groove is provided in the outer circumferential face of the container body. The spiral protrusion 33*a* is for discharging toner from the container body 33 through the toner outlet C of the toner container 32Y by rotation of the container body 33.

The container body 33 may be produced together with the bottle gear 37 as a single unit by blow molding.

Referring to FIG. 3, a cap receiver 91 of the toner supply device 90Y covers the head portion of the toner container 32Y installed in the installation portion 31 (toner supply device 90Y).

The cap receiver 91 includes a cap chuck 92 for opening and closing the cap 34 in conjunction with the attachment and detachment operation of the toner container 32Y and an opening-closing driver for driving the cap chuck 92. The cap receiver is a part of the receiver 81Y as well as the falling path 82. Then, as the toner container 32Y mounted on the installation portion 31 is slid toward the cap receiver 91 and the cap 34 reaches a position of the cap chuck 92, the opening-closing driver operates so that the cap 34 is separated from the toner outlet C in a state where the cap chuck 92 holds the cap 34 in conjunction with an operation of the toner container 32Y that is slid further and pushed in. Thus, the toner outlet C of the toner container 32Y is opened, and toner can be discharged from the toner outlet C. Further, in conjunction with such a mounting operation of the toner container 32Y, the locking mechanism is operated to lock the head portion of the toner container 32Y so as not to be removed from the installation portion 31. At that time, the toner container 32Y is secured to the toner supply device 90Y so that the toner discharge port C side (head) of the toner container 32Y is rotatable, and the container body 33 is rotatably supported on the installation portion 31.

In removal of the toner container 32Y from the installation portion 31, the above-described processes are performed in reverse.

Toner discharged from the toner container 32Y drops through the falling path 82 to the bowl-shaped reservoir 81Y and stored therein. The reservoir 81Y includes a toner detector 86 and stirring member. The conveyance pump 60Y coupled to the suction port 83 of the reservoir 81Y via the tube 95Y sucks the toner in the reservoir 81Y and conveys the toner through the tube 95Y.

As described above, in the present embodiment, the toner discharged from the toner container 32Y is not directly sucked by the conveyance pump 60Y but is stored in the reservoir 81Y to some extent. Then, the necessary amount of toner is sucked by the conveyance pump 60Y. Accordingly, such a configuration can minimize shortage of the toner sucked by the conveyance pump 60Y.

The toner detector 86 is disposed near the suction port 83 and indirectly detects a state in which the toner contained in the toner container 32Y is depleted (toner depleted), or a state close thereto (toner near depletion). Then, the toner is discharged from the toner container 32Y based on the detection result of the toner detector 86.

For example, a piezoelectric sensor or a light transmission sensor can be used as the toner detector 86. In the present embodiment, a piezoelectric sensor is used as the toner detector 86. The height of the detection surface of the toner detector 86 is set so that the amount of toner (deposition height) deposited above the suction port 83 is a target value.

Based on the detection result of the toner detector 86, the controller 120 controls a drive timing and a drive duration of the drive motor 115 to rotationally drive the toner container 32Y (the container body 33). Specifically, when the controller 120 determines that there is no toner at the detection position based on the detection result of the toner detector 86, the drive motor 115 is driven for a predetermined time.

On the other hand, when the controller 120 determines that the toner is present at the detection position based on the detection result of the toner detector 86, the drive motor 115 is stopped.

Next, referring to FIGS. 5 to 12, the configuration and operation of the image forming apparatus 100 according to the present embodiment are described below.

As described in FIG. 1, in the image forming apparatus 100 according to the present embodiment, the plurality of photoconductor drums 1Y, 1M, 1C, 1K, and is as the image bearer are arranged side by side along the intermediate transfer belt 8 in the rotation direction of the intermediate transfer belt 8. The intermediate transfer belt 8 as the intermediate transferor rotates in a predetermined direction (clockwise in FIG. 1). As illustrated in FIGS. 5A and 5B, the image forming apparatus 100 further includes the plurality of developing devices 5Y, 5M, 5C, 5K, and 5S to develop latent images formed on the plurality of photoconductor drums 1Y, 1M, 1C, 1K, and 1S (image bearers); the plurality of toner containers 32Y, 32M, 32C, 32K, and 32S (developer containers) each containing the toner as the developer; the plurality of tubes 95Y, 95M, 95C, 95K, and 95S as conveyance paths to supply the toner contained in the plurality of toner containers 32Y, 32M, 32C, 32K, and 32S to the plurality of developing devices 5Y, 5M, 5C, 5K, and 5S respectively; and the plurality of sub-hoppers 70Y, 70M, 70C, 70K, and 70S to couple the plurality of tubes 95Y, 95M, 95C, 95K, and 95S and the plurality of developing devices 5Y, 5M, 5C, 5K, and 5S, respectively.

Further, in the present embodiment, as described above, at least one set of the photoconductor drum 1, the developing device 5, and the sub-hopper 70 among the plurality of photoconductor drums 1Y, 1M, 1C, 1K, and 1S; the plurality of developing devices 5Y, 5M, 5C, 5K, and 5S; and the plurality of sub-hoppers 70Y, 70M, 70C, 70K, and 70S is disposed at a height differing from those of the other sets. Specifically, in the present embodiment, the developing device 5S, the sub-hopper 70S, and the photoconductor drum 1S located at the extreme upstream position are disposed at the height lower than those of the other sets.

More specifically, the height of the process cartridge 6S (the unit in which the photoconductor drum 1S, the developing device 5S, the charging device, and the cleaner are together formed as a single unit) located at the leftmost position in FIGS. 1 and 5A is lower than the heights of the other process cartridges 6Y, 6M, 6C, and 6K by the predetermined value H. In addition, as illustrated in FIG. 1, the height of the sub-hopper 70S (the unit including the conveyance pump 60S) located at the leftmost position is lower than the heights of the other sub-hoppers 70Y, 70M, 70C, and 70K by the predetermined value H. As described above, the positional relation, in which only the height of the process cartridge 6 and the sub-hopper 70 (and the conveyance pump 60) at the extreme upstream position is low, does not change even if the process cartridges 6 and the sub-hoppers 70 (and the conveyance pumps 60) are rearranged as described later.

In the present embodiment, as described above, if necessary, the arrangement order of the plurality of developing devices 5Y, 5M, 5C, 5K, and 5S and the plurality of sub-hoppers 70Y, 70M, 70C, 70K, and 70S in the rotation direction of the intermediate transfer belt 8 is changed under the following conditions. The arrangement of the plurality of toner containers 32Y, 32M, 32C, 32K, and 32S (developer containers) is not changed. Connections between the plurality of developing devices 5Y, 5M, 5C, 5K, and 5S and the plurality of sub-hoppers 70Y, 70M, 70C, 70K and 70S is not changed. The layout of the plurality of tubes 95Y, 95M, 95C, 95K, and 95S is changed so that the connections between the plurality of tubes 95Y, 95M, 95C, 95K, and 95S (conveyance path) and the plurality of sub-hoppers 70Y, 70M, 70C, 70K, and 70S is not changed.

Specifically, as described above, each of the plurality of developing devices 5Y, 5M, 5C, 5K, and 5S together with the corresponding one of the plurality of photoconductor drums 1Y, 1M, 1C, 1K, and 1S forms the corresponding one of the process cartridges 6Y, 6M, 6C, 6K, and 6S.

A corresponding one of the plurality of conveyance pumps 60Y, 60M, 60C, 60K, and 60S is installed in the corresponding one of the plurality of sub-hoppers 70Y, 70M, 70C, 70K, and 70S. The plurality of conveyance pumps 60Y, 60M, 60C, 60K, and 60S are removably coupled to downstream side openings of the plurality of tubes 95Y, 95M, 95C, 95K, and 95S (conveyance paths), respectively.

Therefore, the plurality of process cartridges 6Y, 6M, 6C, 6K, and 6S; the plurality of conveyance pumps 60Y, 60M, 60C, 60K, and 60S; and the plurality of sub-hoppers 70Y, 70M, 70C, 70K can be arranged in the rotation direction of the intermediate transfer belt 8, without changing the arrangement of the plurality of toner containers 32Y, 32M, 32C, 32K, and 32S, and without changing the connections among the plurality of process cartridges 6Y, 6M, 6C, 6K, and 6S; the plurality of conveyance pumps 60Y, 60M, 60C, 60K, and 60S; and the plurality of sub-hoppers 70Y, 70M, 70C, 70K, and 70S. In addition, the layout of the plurality of tubes 95Y, 95M, 95C, 95K, and 95S is changed without changing the connections between the plurality of tubes 95Y, 95M, 95C, 95K, and 95S (conveyance paths) and the plurality of sub-hoppers 70Y, 70M, 70C, 70K, and 70S.

More specifically, in the present embodiment, without changing the arrangement of the plurality of toner containers 32Y, 32M, 32C, 32K, and 32S, the developing device 5S and the sub-hopper 70S located at the extreme upstream position and the developing device 5K and the sub-hopper 70K located at the extreme downstream position are swapped, and the layout of two tubes 95K and 95S of the plurality of tubes 95Y, 95M, 95C, 95K, and 95S corresponding to two sets (one of which is the development device 5S and the sub-hopper 70S for special color and the other is the development device 5K and the sub-hopper 70K for black) is changed.

That is, a state A illustrated in FIG. 5A and a state B illustrated in FIG. 5B are properly switched. In the state A, the process cartridge 6S and the sub-hopper 70S (and the conveyance pump 60S) for special color are located at the extreme upstream position and the process cartridge 6K and the sub-hopper 70K (and the conveyance pump 60K) for black are located at the extreme downstream position. In the state B, the process cartridge 6S and the sub-hopper 70S (and the conveyance pump 60S) for special color are located at the extreme downstream position and the process cartridge 6K and the sub-hopper 70K (and the conveyance pump 60K) for black are located at the extreme upstream position.

The specific rearrangement operation is to replace the process cartridge 6S and the sub-hopper 70S (and the conveyance pump 60S) for special color and the process cartridge 6K and the sub-hopper 70K (and the conveyance pump 60K) for black, and to change the layout of the tube 95S for special color and the tube 95K for black, without rearranging the five toner containers 32Y, 32M, 32C, 32K, and 32S.

Here, the length in the conveyance direction of each of the above-mentioned two tubes 95K and 95S is set in accordance with the farther of the two sub-hoppers 70K and 70S from the toner containers 32K and 32S.

Therefore, in the rearrangement operation of the developing devices 5K and 5S (the process cartridges 6K and 6S) and the sub-hopper 70K and 70S (and conveyance pumps 60K and 60S) from the state A illustrated in FIG. 5A to the state B illustrated in FIG. 5B (or from the state B illustrated in FIG. 5B to the state A illustrated in FIG. 5A), the tubes 95K and 95S are long enough to change the layout of the tubes 95K and 95S.

With this configuration according to the present embodiment, without changing the coupling of the plurality of tubes 95Y, 95M, 95C, 95K, and 95S to supply toner to the plurality of developing devices 5Y, 5M, 5C, 5K, and 5S, without changing the arrangement of the plurality of toner containers 32Y, 32M, 32C, 32K, and 32S, the arrangements of the plurality of developing devices 5Y, 5M, 5C, 5K, and 5S and the plurality of sub-hoppers 70Y, 70M, 70C, 70K, and 70S are changed, and the layout of the plurality of tubes 95Y, 95M, 95C, 95K, and 95S is changed. Therefore, the order of the overlapping toner colors on the intermediate transfer belt 8 (or the recording medium P) can be easily changed without multiple rotation of the intermediate transfer belt 8. Accordingly, as described above, an optimum image can be formed according to the application. In addition, even if the arrangement is changed in such a manner, toners of different colors are not mixed in the developing device or the sub-hopper (color mixing does not occur).

Referring to FIGS. 5A and 5B, the image forming apparatus 100 according to the present embodiment includes a motor 150 as a driving source to drive the first conveyance screw 71 and the second conveyance screw 72 in the plurality of sub-hoppers 70Y, 70M, 70C, 70K, and 70S. That is, in the present embodiment, the five sub-hoppers 70Y, 70M, 70C, 70K, and 70S are driven by one common driving source (motor 150), not respective separated driving sources. With this configuration, it is possible to reduce the size and cost of the apparatus.

Referring to FIGS. 5A, 5B, 6A, and 6B, the image forming apparatus 100 includes a drive shaft 151 rotated by the motor 150 (one driving source). The drive shaft 151 extends in the rotation direction of the intermediate transfer belt 8 (the arrangement direction of the process cartridges 6Y, 6M, 6C, 6K, and 6S and the sub-hoppers 70Y, 70M, 70C, 70K, and 70S and the horizontal direction).

A plurality of drive gears 152 that rotates together with the drive shaft 151 is disposed on the drive shaft 151. Each of the five drive gears 152 is disposed at a position to transmit a driving force to the corresponding sub-hopper 70 among the five sub-hoppers 70Y, 70M, 70C, 70K, and 70S.

A plurality of driven gears 154 for driving the plurality of sub-hoppers 70Y, 70M, 70C, 70K, and 70S, respectively, is disposed in the plurality of sub-hoppers 70Y, 70M, 70C, 70K, and 70S. The five driven gears 154 are provided so that the driving force is input to the corresponding sub-hopper 70 among the five sub-hoppers 70Y, 70M, 70C, 70K, and 70S, respectively.

In addition, the image forming apparatus 100 includes a plurality of relay gears 153 (relay gear trains) for coupling and transmitting the driving force of the plurality of driving gears 152 to the plurality of driven gears 154, respectively. The five relay gears 153 are provided so that the driving force of the driving gear 152 is transmitted to the driven gear 154 of the corresponding sub-hopper 70 among the five sub-hoppers 70Y, 70M, 70C, 70K, and 70S, respectively.

In the present embodiment, the motor 150 (one drive source), the drive shaft 151, and the plurality of driving gears 152, and the plurality of relay gears 153 (relay gear trains) are supported by the apparatus body 100A. Therefore, even when the process cartridges 6K and 6S and the sub-hoppers 70K and 70S (and the conveyance pumps 60K and 60S) are swapped in position as described above, the motor 150, the drive shaft 151, the five driving gears 152, and the five relay gears 153 do not move.

Figure 6A:
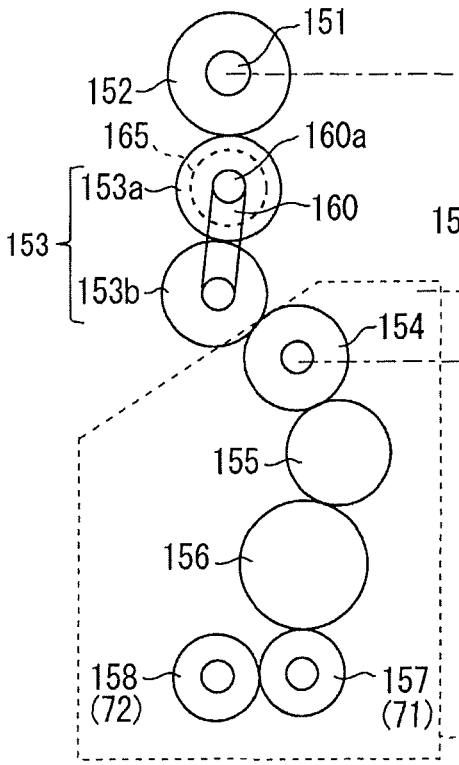
FIG. 6A is a schematic diagram illustrating a drive mechanism of a sub-hopper at an extreme upstream position in the rotation direction of the intermediate transfer belt.
Figure 6B:
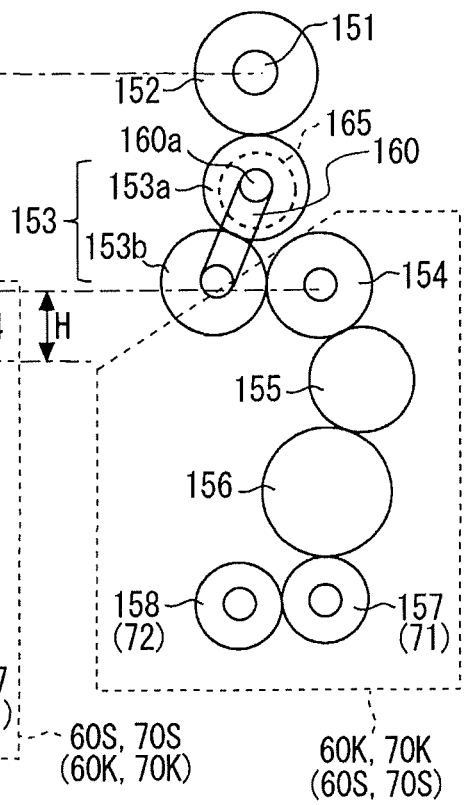
FIG. 6B is a schematic diagram illustrating a drive mechanism of a sub-hopper at an extreme downstream position in the rotation direction of the intermediate transfer belt.

Referring to FIGS. 6A and 6B, in addition to the driven gear 154, gears 155 to 158 (i.e., gear train) for transmitting the driving force to the first conveyance screw 71 and the second conveyance screw 72 are disposed in the five sub-hoppers 70Y, 70M, 70C, 70K and 70S. That is, as the driving force (driving of the motor 150) input to the driven gear 154 is transmitted to the first conveyance screw 71 and the second conveyance screw 72 via the gears 155 to 158 (gear train), the first conveyance screw 71 and the second conveyance screw 72 are rotated at predetermined rotational speeds in a predetermined direction.

In this embodiment, each of the conveyance pumps 60Y, 60M, 60C, 60K, and 60S is united with the corresponding one of the five sub-hoppers 70Y, 70M, 70C, 70K, and 70S. A motor 67 is an independent driving source for driving each of the conveyance pumps 60Y, 60M, 60C, 60K, and 60S.

Alternatively, one motor 150 for driving the five sub-hoppers 70Y, 70M, 70C, 70K, and 70S can also be used as a driving source for driving the five conveyance pumps 60Y, 60M, 60C, 60K, and 60S. That is, five sub-hoppers 70Y, 70M, 70C, 70K, and 70S and five conveyance pumps 60Y, 60M, 60C, 60K, and 60S can be driven by one motor 150. In that case, the gear trains disposed in the five sub-hoppers 70Y, 70M, 70C, 70K, and 70S are coupled to the conveyance pumps 60Y, 60M, 60C, 60K, and 60S to transmit the driving force in addition to the first conveyance screw 71 and the second conveyance screw 72.

Here, as illustrated in FIGS. 5A, 5B, 6A, and 6B, in the present embodiment, the plurality of relay gears 153 (gear trains) meshes with the plurality of driving gears 152 and the plurality of driven gears 154 at different positions in accordance with different heights of the plurality of photoconductor drums 1Y, 1M, 1C, 1K, and 1S, the plurality of developing devices 5Y, 5M, 5C, 5K, and 5S, and the plurality of sub-hoppers 70Y, 70M, 70C, 70K, and 70S.

As described above, the five process cartridges 6Y, 6M, 6C, 6K, and 6S and the five sub-hoppers 70Y, 70M, 70C, 70K, and 70S (and the conveyance pumps 60Y, 60M, 60C, 60K, and 60S) substantially have similar configurations except that the color of the conveyed toner is different. The heights of the process cartridge 6S and the sub-hopper 70S (and the conveyance pump 60S) disposed at the extreme upstream position are lower than those of the other four process cartridges 6Y, 6M, 6C, and 6K and the sub-hoppers 70Y, 70M, 70C, and 70K (and the conveyance pumps 60Y, 60M, 60C, and 60K) by the predetermined value H.

Therefore, as illustrated in FIGS. 6A and 6B, the position of the driven gear 154 of the sub-hopper 70S at the extreme upstream position is lower than the position of the driven gear 154 of the sub-hopper 70K at the extreme downstream position (and the three sub-hoppers 70Y, 70M, and 70C at the center position) by the predetermined value H. Thus, it is difficult that the same relay gear 153 transmits the driving force from the driving gears 152 retained at the same height to the driven gears 154 disposed at different heights.

On the other hand, in the present embodiment, the positions at which the relay gear 153 meshes with the driving gear 152 and the driven gear 154 at the extreme upstream position is different from those at the other positions than the extreme upstream position. Therefore, it is possible to transmit the driving force from the driving gear 152 at the same height to the driven gear 154 having a different height.

Accordingly, even when the plurality of photoconductor drums 1Y, 1M, 1C, 1K, and 1S are arranged side by side along the intermediate transfer belt 8, the plurality of developing devices 5Y, 5M, 5C, 5K, and 5S, and the plurality of sub-hoppers 70Y, 70M, 70C, 70K, and 70S are not all disposed at the same height, respectively, the arrangement of the plurality of developing devices 5Y, 5M, 5C, 5K, and 5S and the plurality of sub-hoppers 70Y, 70M, 70C, 70K, and 70S can be changed to change the order of toner colors deposited on the surface of the intermediate transfer belt 8.

More specifically, the relay gear 153 (relay gear train) includes a first idler gear 153*a* meshing with the driving gear 152 and a second idler gear 153*b* meshing with the first idler gear 153*a* and the driven gear 154. The relay gear 153 can change the positions to mesh with the driving gear 152 and the driven gear 154 (at least one of a position at which the relay gear 153 meshes with the driving gear 152 and a position at which the relay gear 153 meshes with the driven gear 154).

Specifically, an arm 160 is pivotable about a support shaft 160*a* of the first idler gear 153*a*. The second idler gear 153*b* is rotatably supported on a shaft on the other end side (the opposite side to the support shaft 160*a*) of the arm 160. The rotation of the arm 160 around the support shaft 160*a* is independent of the rotation of the first idler gear 153*a* and the second idler gear 153*b*. With such a configuration, as the arm 160 is pivoted counterclockwise about the support shaft 160*a* from the position in FIG. 6B to the position in FIG. 6A, the second idler gear 153*b* can mesh with the driven gear 154 having a low height at the extreme upstream position while maintaining engagement between the driving gear 152 and the first idler gear 153*a* and engagement between the first idler gear 153*a* and the second idler gear 153*b*. That is, the driving force can be transmitted from the driving gear 152 at the same height to the driven gear 154 having a different height.

In the present embodiment, the relay gear 153 including the first idler gear 153*a* and the second idler gear 153*b* changes the position in which the relay gear 153 meshes with the driven gear 154 from the position of meshing with the driving gear 152 and the position of meshing with the driven gear 154. Alternatively, it is also possible to change both the position of meshing with the driving gear 152 and the position of meshing with the driven gear 154.

Here, in the present embodiment, the driving forces are transmitted through a plurality of transmission paths from the plurality of driving gears 152 to the plurality of driven gears 154 corresponding to one of the plurality of sub-hoppers 70Y, 70M, 70C, 70K, and 70S. Further, a plurality of electromagnetic clutches 165 as a plurality of switchers switches the transmission and interruption of the plurality of transmission paths at different timings.

More specifically, as illustrated in FIGS. 6A and 6B, in the present embodiment, the first idler gear 153*a* of each of the five relay gears 153 (relay gear trains) includes the electromagnetic clutch 165 that has a gear portion meshing with the driving gear 152. The electromagnetic clutches 165 are turned on and off at different timings, respectively. When the electromagnetic clutch 165 is turned on, the rotation of the gear portion of the electromagnetic clutch 165 is transmitted to the first idler gear 153*a*, and the driving force is transmitted to the sub-hoppers 70Y, 70M, 70C, 70K, and 70S. On the other hand, when the electromagnetic clutch 165 is turned off, the rotation of the gear portion of the electromagnetic clutch 165 is not transmitted to the first idler gear 153*a*, and the driving force is not transmitted to the sub-hoppers 70Y, 70M, 70C, 70K, and 70S.

With this configuration, even in the case where the five sub-hoppers 70Y, 70M, 70C, 70K, and 70S are driven by one motor 150 (driving source), the five electromagnetic clutches 165 are independently turned on or off. Therefore, the five sub-hoppers 70Y, 70M, 70C, 70K, and 70S can be operated to supply toner at different timings according to the toner consumption status of each of the five developing devices 5Y, 5M, 5C, 5K, and 5S.

The image forming apparatus 100 according to the present embodiment includes a tube housing 108 to accommodate a part of at least one tube 95 of the plurality of tubes 95Y, 95M, 95C, 95K, and 95S. The tube 95 is wound or folded without buckling in the tube housing 108.

Specifically, as illustrated in FIGS. 5A and 5B, both the tube 95S for special color and the tube 95K for black are long enough to change the layouts thereof in conjunction with rearrangement of the developing devices 5S and 5K and the sub-hoppers 70S and 70K. Therefore, when the tube 95K or 95S are coupled to nearer sub-hopper 70 (conveyance pump 60) out of the two sub-hoppers 70K and 70S, the length of the tube 95K or 95S becomes excessive.

Figure 7A:
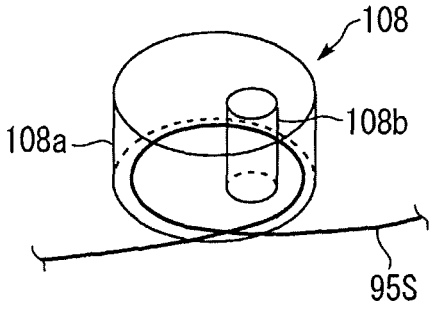
FIGS. 7A and 7B are schematic perspective views of one tube housing of the developer supply device.
Figure 7B:
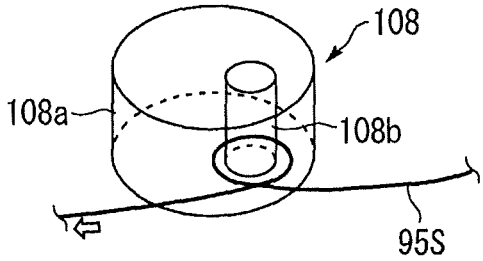

As illustrated in FIGS. 7A and 7B, the tube housing 108 can reel in a portion of the tube 95S without buckling and can prevent slackness and entanglement of the tube 95S without reducing toner conveyance ability. Note that, in FIGS. 7A and 7B, only the tube housing 108 for accommodating the tube 95S for special color is illustrated, and the illustration of the tube housing for accommodating the tube 95K for black is omitted.

More specifically, as illustrated in FIGS. 7A and 7B, the tube housing 108 is a cylindrical member having a core shaft 108*b* therein, around which the tube 95S winds one round inside the cylindrical portion 108*a*. The tube housing 108 is shaped to allow the size of winding of the tube 95S to change. That is, when the distance between both ends (an end portion coupled to the supply source and an end portion coupled to the supply destination) of the tube 95S is short as illustrated in FIG. 5B, the size of winding of the tube 95S circling around the core shaft 108*b* is enlarged to be closer to the inner wall of the cylindrical portion 108*a* as illustrated in FIG. 7A. On the other hand, when the distance between both ends of the tube 95S is long as illustrated in FIG. 5A, the size of winding of the tube 95S circling around the core shaft 108*b* is reduced so that the tube 95S becomes closer to the core shaft 108*b* as illustrated in FIG. 7B.

It is to be noted that the inner wall of the cylindrical portion 108*a* of the tube housing 108 has a curvature larger than the maximum curvature at which buckling occurs in the tube 95S.

Figure 8A:
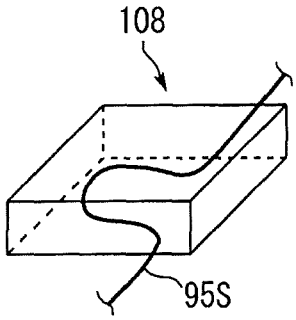
FIGS. 8A and 8B are schematic perspective views of another tube housing of the developer supply device.
Figure 8B:
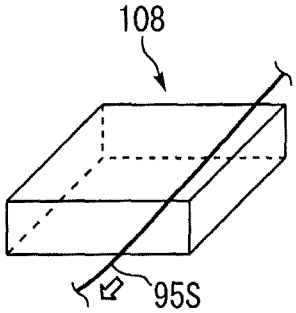

In addition to the configuration illustrated in FIGS. 7A and 7B, the tube housing 108 can be configured to fold a part of the tube 95S without buckling as illustrated in FIGS. 8A and 8B.

When the distance between both ends of the tube 95S is short, the tube 95S is folded into a substantially wave shape with moderate curvature inside the tube housing 108 as illustrated in FIG. 8A. On the other hand, when the distance between both ends of the tube 95S is long, the folding of the tube 95S is eliminated and the tube 95S is stretched inside the tube housing 108 as illustrated in FIG. 8B.

Figure 9:
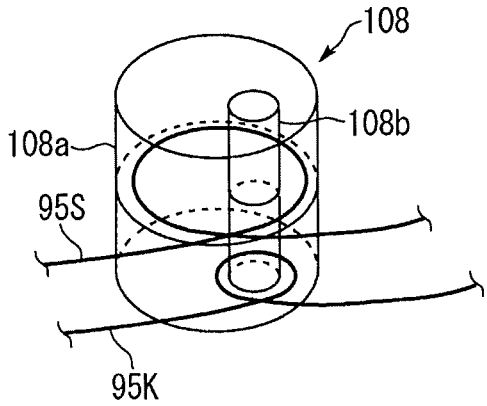
FIG. 9 is a schematic perspective view of yet another tube housing of the developer supply device.

Alternatively, as illustrated in FIG. 9, a plurality of tube housings 108 (for example, one for special color and one for black) can be stacked one on another. In the present embodiment, as illustrated in FIGS. 5A and 5B, when the tube 95S for special color is long (or short), the tube 95K for black is short (or long). Therefore, the winding state of the two tubes 95K and 95S is opposite each other as illustrated in FIG. 9.

Here, in the present embodiment, at least one of the plurality of tubes 95Y, 95M, 95C, 95K, and 95S can be covered with a reinforcement 105 to reinforce the tube 95 so that the tube 95 does not crimp.

Figure 10:
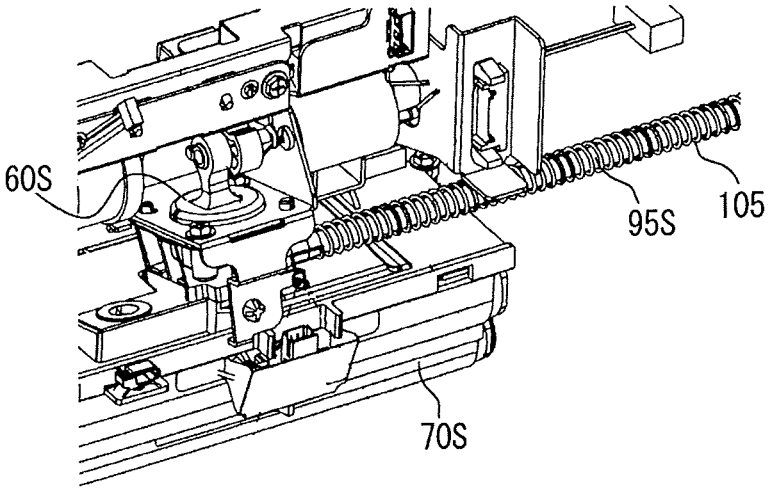
FIG. 10 is a perspective view of a reinforced tube of the developer supply device.

Specifically, as illustrated in FIG. 10, the reinforcement 105 is, for example, a coil wound around the tube 95S so as to cover the outer periphery of the tube 95S over the entire region in the conveyance direction of the tube 95S. Thus, the reinforcement 105 prevents buckling of the flexible tube 95S causing decrease of the toner conveyance ability of the tube 95S.

In FIG. 10, the reinforcement 105 is installed in the tube 95S for special color, but the reinforcement 105 can also be installed in the other tubes 95Y, 95M, 95C, and 95K.

Figure 11A:
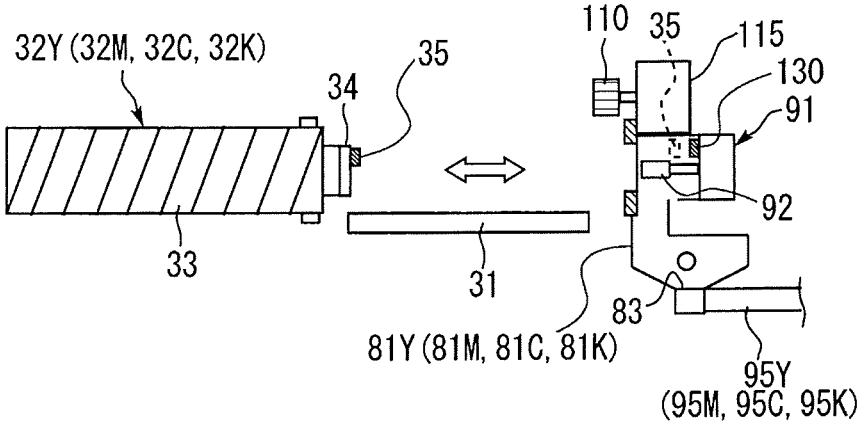
FIG. 11A is a schematic view illustrating an installation of developer containers for colors and black in the developer supply device.
Figure 11B:
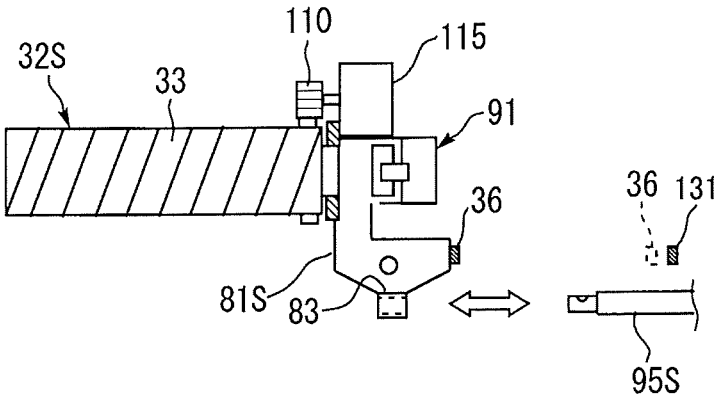
FIG. 11B is a schematic view illustrating an installation of a developer container for special color in the developer supply device together with a reservoir.

Here, in the present embodiment, as illustrated in FIG. 11B, the toner container 32S and the reservoir 81S are removably installed as a single unit in the toner supply device 90S for special color. Specifically, the suction port 83 of the single unit of the toner container 32S and the reservoir 81S is removably coupled to an upstream side opening (nozzle portion) of the tube 95S. Since the toner container 32S and the reservoir 81S together form the single unit, even when the toner container 32S for special color of a different type is replaced, this configuration alleviates color mixing in the reservoir 81S after replacement with special color toner before replacement.

On the other hand, as illustrated in FIG. 11A, similarly to the toner supply devices 90Y, 90M, and 90C for colors, the toner container 32K is removably coupled to the reservoir 81K of the toner supply device 90K for black.

In any of the toner supply devices 90Y, 90M, 90C, 90K, and 90S, as described above, the tubes 95Y, 95M, 95C, 95K, and 95S are laid out in a space where various components are congested, and it is difficult to perform the rearrangement work. Therefore, in principle, the user can change the layout of the tubes 95Y, 95M, 95C, 95K, and 95S (coupling to the supply destination) without removing the tubes 95Y, 95M, 95C, 95K, and 95S from the apparatus body 100A.

Further, in the present embodiment, as illustrated in FIG. 12, the conveyance pump 60S is removably coupled to the toner supply device 90S together with the sub-hopper 70S (supplied portion) as a unit. Further, the developing device 5S (process cartridge 6S) coupled to the conveyance pipe 98 is removably coupled to the unit including the conveyance pump 60S and the sub-hopper 70S. When the toner container 32S (and the reservoir 81S) for special color is replaced with that of the different type, the conveyance pump 60S, the sub-hopper 70S, and the developing device 5S for special color are replaced with those of the different type corresponding to the replaced toner container 32S (and the reservoir 81S) as illustrated in FIG. 12. These configurations alleviate color mixing in the developing device 5S or the sub-hopper 70S for special color after replacement with the special color toner before replacement.

In the present embodiment, as illustrated in FIG. 12, a shutter 79 for opening and closing the discharge port 74 is provided in the unit including the conveyance pump 60S and the sub-hopper 70S. The shutter 79 is opened and closed in conjunction with the installment and removal operation of the developing device 5S. Thus, the shutter 79 prevents the toner leakage from the discharge port 74 of the sub-hopper 70 even when the developing device 5S is removed from the unit including the conveyance pump 60S and the sub-hopper 70S.

Further, in the toner supply device 90K for black according to the present embodiment, similarly to the toner supply device 90S for special color, the unit including the conveyance pump 60K and the sub-hopper 70K, and the developing device 5K are separately installed and removed, respectively as illustrated in FIG. 12.

Here, as illustrated in FIG. 11B, the single unit of the toner container 32S and the reservoir 81S includes an electronic substrate 36 storing information on the type of toner and the like. In the apparatus body 100A, when the single unit of the toner container 32S and the reservoir 81S is normally set, an antenna substrate 131 reads the information stored in the electronic substrate 36 and sends the information to the controller 120.

Further, as illustrated in FIG. 11A, the toner containers 32Y, 32M, 32C, and 32K for colors and black include electronic substrates 35 storing information on the type of toner and the like. In the cap receiver 91 (apparatus body 100A), when the toner containers 32Y, 32M, 32C, and 32K are normally set, antenna substrates 130 read the information stored in the electronic substrates 35 and send the information to the controller 120.

With these configurations, the controller 120 can detect a state in which the toner container 32S (and the reservoir 81S) for special color is normally replaced with a desired type.

As illustrated in FIG. 12, the unit including the conveyance pump 60S and sub-hopper 70S includes an electronic substrate 133 storing information on the type of toner and the like. Further, in the apparatus body 100A, when the unit including the conveyance pump 60S and the sub-hopper 70S is normally set, an antenna substrate 132 reads the information stored in the electronic substrate 133 and sends to the controller 120.

Further, the developing device 5S includes an electronic substrate 135 storing information on the type of toner and the like. Further, the sub-hopper 70S of the toner supply device 90 includes an antenna substrate 134 for reading information stored in the electronic substrate 135 and sending the information to the controller 120 when the developing device 5S is normally set.

With these configurations, the controller 120 can detect a state in which the conveyance pump 60S, the sub-hopper 70S, and the developing device 5S for special color are normally replaced with desired types.

As described above, in the image forming apparatus 100 according to the present embodiment, the arrangement of the plurality of developing devices 5Y, 5M 5C, 5K, and 5S and the plurality of sub-hoppers 70Y, 70M, 70C, 70K, and 70S in the rotation direction of the intermediate transfer belt 8 is changed while satisfying the following. The arrangement of the plurality of toner containers 32Y, 32M, 32C, 32K, and 32S (developer containers) is not changed. The connections between the plurality of developing devices 5Y, 5M, 5C, 5K, and 5S and the plurality of sub-hoppers 70Y, 70M, 70C, 70K and 70S is not changed. The layout of the plurality of tubes 95Y, 95M, 95C, 95K, and 95S is changed so that the connections between the plurality of tubes 95Y, 95M, 95C, 95K, and 95S (conveyance paths) and the plurality of sub-hoppers 70Y, 70M, 70C, 70K, and 70S is not changed.

Accordingly, in the case where the plurality of photoconductor drums 1Y, 1M, 1C, 1K, and 1S (image bearers) arranged side by side along the intermediate transfer belt 8 (intermediate transferor); the plurality of developing devices 5Y, 5M, 5C, 5K, and 5S; and the plurality of sub-hoppers 70Y, 70M, 70C, 70K, and 70S are not all disposed at the same height, respectively, the arrangement of the plurality of developing devices 5Y, 5M, 5C, 5K, and 5S and the plurality of sub-hoppers 70Y, 70M, 70C, 70K, and 70S can be easily changed, thereby changing the order of toner colors deposited on the surface of the intermediate transfer belt 8.

In the embodiments described above, the photoconductor drum 1Y serving as the image bearer, the charger 4Y, the developing device 5Y, and the cleaner 2Y are united as the process cartridge 6Y. However, the present disclosure is not limited to the embodiments described above, and applied to the apparatus body 100A in which the developing device 5Y is removably installed as a single unit.

It is to be noted that the term "process cartridge" used in this specification means a unit including an image bearer and at least one of a charging device, a developing device, and a cleaner united together and is designed to be removably installed together in the apparatus body of the image forming apparatus.

Additionally, although the toner container 32S including the substantially cylindrical, rotatable container body is removably installed in the toner supply device 90S in the embodiments described above, the shape of the toner containers 32S installed in the toner supply device 90S are not limited thereto. This disclosure can adapt to toner supply devices, in which, for example, a box-shaped toner container is installed.

In such configurations, effects similar to those described above are also attained.

Further, in the embodiments described above, the plurality of relay gears 153 are supported by the apparatus body 100A together with the motor 150 (drive source) and the like. Alternatively, each of the plurality of relay gears 153 can be supported by the corresponding sub-hopper among the plurality of sub-hoppers 70Y, 70M, 70C, 70K, and 70S, together with the corresponding driven gear among the plurality of driven gears 154. In this case, when the relay gear 153 installed in the sub-hopper is placed at a different height, the height of the relay gear 153 is adjusted accordingly.

In such configurations, effects similar to those described above are also attained.

The above-described embodiments are illustrative and do not limit the present disclosure. Numerous additional modifications and variations are possible in light of the above teachings. It is therefore to be understood that within the scope of the present disclosure, the present disclosure may be practiced otherwise than as specifically described herein. The number, position, and shape of the components of the image forming apparatus described above are not limited to those described above.

What is claimed is:

1. An image forming apparatus comprising:

an apparatus body;

an intermediate transferor to rotate in a predetermined rotation direction;

a plurality of image bearers disposed along the intermediate transferor in the predetermined rotation direction of the intermediate transferor to bear latent images;

a plurality of developing devices to develop the latent images on the plurality of image bearers;

a plurality of developer containers to contain developers;

a plurality of conveyance paths each corresponding to a respective one of the plurality of developing devices and a respective one of the plurality of developer containers, to supply the developers contained in the plurality of developer containers to the plurality of developing devices respectively; and a plurality of sub-hoppers each to couple a respective one of the plurality of conveyance paths and a respective one of the plurality of developing devices, at least one set of an image bearer, a developing device, and a sub-hopper, among sets of the plurality of image bearers, the plurality of developing devices, and the plurality of sub-hoppers, disposed at a height different from other sets of the plurality of image bearers, the plurality of developing devices, and the plurality of sub-hoppers, an arrangement of the plurality of developer containers unchanged while an arrangement of the plurality of developing devices and the plurality of sub-hoppers in the predetermined rotation direction is changed without changing connections between the plurality of developing devices and the plurality of sub-hoppers, and a layout of the plurality of conveyance paths changed without changing connections between the plurality of conveyance paths and the plurality of sub-hoppers.

2. The image forming apparatus according to claim 1, further comprising one driving source to drive the plurality of sub-hoppers.

3. The image forming apparatus according to claim 2, further comprising:

a drive shaft extending in the predetermined rotation direction to be rotated by the one driving source;

a plurality of driving gears to rotate together with the drive shaft;

a plurality of driven gears to drive the plurality of sub-hoppers; and a plurality of relay gears to couple the plurality of driving gears and the plurality of driven gears and transmit driving forces of the plurality of driving gears to the plurality of driven gears, the plurality of relay gears to mesh the plurality of driving gears and the plurality of driven gears at different positions in accordance with the plurality of image bearers, the plurality of developing devices, and the plurality of sub-hoppers disposed at different heights.

4. The image forming apparatus according to claim 3, wherein the plurality of relay gears is configured to change positions at which the plurality of relay gears meshes with the plurality of driving gears and the plurality of driven gears.

5. The image forming apparatus according to claim 3, further comprising a plurality of switchers disposed on a plurality of transmission paths from the plurality of driving gears to the plurality of driven gears to switch transmission and interruption of the driving forces of the plurality of driving gears to the plurality of sub-hoppers at different timings.

6. The image forming apparatus according to claim 3, wherein the plurality of relay gears, the one driving source, the drive shaft, and the plurality of driving gears are together supported by the apparatus body.

7. The image forming apparatus according to claim 3, wherein the plurality of relay gears is supported by the plurality of sub-hoppers together with the plurality of driven gears.

8. The image forming apparatus according to claim 1, further comprising a tube housing, wherein the plurality of conveyance paths is a plurality of tubes, and wherein the tube housing is configured to accommodate at least one of the plurality of tubes without buckling the at least one of the plurality of tubes.

9. The image forming apparatus according to claim 1, wherein the arrangement of the plurality of developer containers is unchanged, wherein two sets of developing devices and sub-hoppers located at an extreme upstream position and at an extreme downstream position among the plurality of developing devices and the plurality of sub-hoppers in the predetermined rotation direction are swapped, wherein a layout of two conveyance paths of the plurality of conveyance paths corresponding to two sets of developing devices and sub-hoppers located at the extreme upstream position and at the extreme downstream position is changed, wherein a first set of the two sets is a developing device and a sub-hopper for special color and a second set of the two sets is a developing device and a sub-hopper for black, wherein a set of a developing device and a sub-hopper located at the extreme upstream position is disposed at a height lower than other sets of developing devices and sub-hoppers.

10. The image forming apparatus according to claim 1, further comprising a plurality of conveyance pumps each to form a unit including a respective one of the plurality of sub-hoppers, wherein each of the plurality of conveyance pumps is removably coupled to a downstream opening of a respective one of the plurality of conveyance paths, wherein the plurality of developing devices and the plurality of image bearers together form a plurality of process cartridges, wherein the arrangement of the plurality of developer containers is unchanged, wherein an arrangement of the plurality of process cartridges, the plurality of conveyance pumps, and the plurality of sub-hoppers in the predetermined rotation direction is changed without changing connections between the plurality of process cartridges, the plurality of the conveyance pumps, and the plurality of sub-hoppers, wherein the layout of the plurality of conveyance paths is changed without changing connections between the plurality of conveyance paths and the plurality of conveyance pumps.

* * * * *